US005477909A

United States Patent [19]

Becker

[11] Patent Number: 5,477,909

[45] Date of Patent: Dec. 26, 1995

[54] APPARATUS FOR THE PROCESSING OF FOUNDRY SANDS

[75] Inventor: Norbert Becker, Freudenberg, Germany

[73] Assignee: Forder- und Anlagentechnik GmbH, Niderfischbach, Germany

[21] Appl. No.: 158,975

[22] Filed: Nov. 29, 1993

[30] Foreign Application Priority Data

Nov. 27, 1992 [DE] Germany ..... 42 39 901.7
Jul. 9, 1993 [DE] Germany ..... 43 22 947.6

[51] Int. Cl.[6] ..... B22C 5/00; B22C 5/10

[52] U.S. Cl. ..... 164/412; 164/5

[58] Field of Search ..... 164/5, 412

[56] References Cited

U.S. PATENT DOCUMENTS 5,045,090 9/1991 Pohl ..... 164/5
5,251,684 10/1993 Andrews et al. ..... 164/5
5,279,741 1/1994 Schott ..... 164/5

FOREIGN PATENT DOCUMENTS 2946299 5/1981 Germany ..... 164/5
60216949 10/1995 Japan ..... 164/5

*Primary Examiner*—P. Austin Bradley
*Assistant Examiner*—I. H. Lin
*Attorney, Agent, or Firm*—Herbert Dubno

[57] ABSTRACT

A mold sand is regenerated with or without mixing with new sand and followed by the addition of binder to it by fluidizing the sand in a chamber as it passes from an inlet to an outlet which can be a step or downcomer opening into the mixer. Compressed air is forced from below through the sand and entrains away small particles while coarse particles or heavy pieces are collected in a discharge unit which can be opened from time to time to carry away the coarse materials.

19 Claims, 3 Drawing Sheets

APPARATUS FOR THE PROCESSING OF FOUNDRY SANDS

FIELD OF THE INVENTION

My present invention relates to an apparatus for improving the reusability and working characteristics of sands, especially old foundry sands and new sand for foundry use.

BACKGROUND OF THE INVENTION

Especially in the foundry field and, indeed, whenever sand castings are made, following the casting process a used sand becomes available which may have to be reprocessed, inter alia, to remove contaminants, and may have to be combined with new sand or fresh sand and, in some cases, with special sands for particular purposes in the foundry arts, before the sand is reused for the production of molds and the like.

Apparatus for the processing of sand, both used sand and new sand, generally comprises a housing having a sand inlet and a sand outlet.

The characteristics of the treated sand which are important are a uniform particle size, a freedom from detrimental contaminants, the presence of binder residues which may be advantageous, and, in the case of used sands, a freedom from dust, slime and the like. The product should also be free from large agglomerates and metal sputterings from the casting process as well as other impurities which may be detrimental to a subsequent casting process.

In the past the apparatus has been designed to free the sand from contaminants and thus prepare the sand for reuse, both in the case of used sand and in the case of mixtures of used sand with fresh or new sand.

By and large prior apparatuses for this purpose have proved to be unsatisfactory because the sand during the process was subjected to different temperatures and different humidity levels so that an optimal treatment could not be assured. Further a homogeneous reproducible product could not be ensured.

OBJECT OF THE INVENTION

It is the principal object of the invention to provide an improved apparatus for the processing of sands, especially mold sands, which at low cost will produce a well-mixed sand at a predetermined temperature and free from detrimental components and with respect to which only relatively small amounts of additional binder must be added to finally prepare the sand for use as a mold or casting sand.

It is also an object of the invention to provide an apparatus which is capable of producing sand that is readily meterable or dosable, i.e. having flow properties which enable the sand to be metered or delivered in readily monitorable and carefully-controlled amounts with a minimum of problems.

Another object of the invention is to provide an improved apparatus for the processing of sand for the purposes described which can be operated more economically and efficiently than earlier apparatus.

SUMMARY OF THE INVENTION

These objects and others which will become apparent hereinafter are attained, in accordance with the invention in an apparatus for improving the reusability and working characteristics of sands, especially used mold sand and new sand and having a sand inlet and a sand outlet at spaced-apart locations along the housing of the apparatus. According to the invention, above the bottom of the housing, an aeration device is provided which is fed by a compressed air supply fitting and can include an intermediate bottom with a plenum form between that bottom and the floor and into which the compressed air is introduced. The roof or ceiling of the housing has a vented fitting for volatile contaminants and dust which is entrained with the air fluidizing the sand above the intermediate bottom and the intermediate bottom is provided with at least one discharge device which is closable but which can be opened to carry away coarse components and those of greater specific gravity than the sand.

The aeration device can, in accordance with the invention, be formed by a group of pipes provided with openings in their respective walls and through which the aerating air can emerge.

Alternatively the aerating device can be constituted by a porous and/or finely perforated intermediate bottom below which the plenum is provided and into which the compressed air pipe opens.

In the housing, at least one rotating shaft can be arranged which has impingement paddles engaging in the fluidized bed of sand formed above the intermediate bottom. In the effective range of the embodiment paddles, stationary counter-paddles and/or impingement bars can be provided in the housing. The region in which the fluidization is effected can be controlled by fixed baffles or inserts fitted into the housing and/or by controlling the compressed air supply to the compressed air fitting or pipe.

Advantageously, upstream of the compressed air pipe a heat exchanger can be provided and/or at least one heating unit can be provided within the housing. The heat exchanger and/or the heating unit can be provided with a control and/or regulating device which can respond to the temperatures of the sand before entry into the chamber and/or discharge from the chamber, via respective sensors, to maintain a predetermined temperature of the discharged sand.

According to a further feature of the invention, a mixing unit is provided downstream of the sand outlet and at least one shaft extends into the mixing unit and can be provided with paddles. This shaft can be an extension of the shaft disposed in the fluidizing chamber.

At the connection between the fluidizing chamber and the mixing unit, an overflow step can be provided over which the fluidized sand passes into the mixing unit. The closable outlet for discharging the agglomerated materials or heavier components can be provided with a preferably periodically driven conveyor device which can include one or more worm-type conveyors.

Above the level of the defluidized bed, the housing can be provided with air inlet openings to generate the air flow extending across the level of the fluidized bed, i.e. substantially horizontally and transversely and these air openings can be provided with valves or sliders to control the air influx. The inlet openings also can be provided, if desired, with fittings connecting them to a compressed air source.

It has been found to be advantageous to provide parallel to the level of the fluidized bed of sand within the housing, a baffle plate which is perforated. Furthermore, the overflow step or the downcomer through which the fluidized sand is transferred to the mixing unit can be provided with a power-operated switchable closure member which can be disposed at the upstream or downstream side of this step or downcomer.

The fluidization of the sand over the fluid-permeable intermediate bottom or array of perforated pipes utilizing compressed air, ensures that sludge substances, binder residues which are not bonded to the sand, dust and smaller sand particles than are desirable are entrained by the air through the outlet in the ceiling or roof, while specifically heavier components, like agglomerated or baked components, metal particles and the like collect upon the intermediate bottom and can be removed through the discharge units.

The fluidization of the sand has been found to greatly improve the meterability of the sand products. As a consequence, the apparatus of the invention can serve to improve the working characteristics as well as the reusability of used mold sand, new sand or sand mixtures and can be employed to continuously prepare sand including mixtures thereof when the mixer is part of the apparatus or is a separate component.

More particularly, the apparatus for the processing of foundry sands can comprise:

a housing formed with a processing chamber having an inlet for used and new foundry sands and an outlet for treated sand spaced from the inlet;

aerating means forming an intermediate bottom above a floor of the chamber and provided with a compressed-air connection for fluidizing sand above the bottom and received from the inlet, thereby entraining contaminants upwardly from the sand as the sand moves from a region of the inlet to the outlet;

a venting fitting in a roof of the chamber for discharging air with entrained contaminants; and at least one closable discharge at a level of the bottom for receiving coarse components and components of greater specific gravity than the sand and removing the components from the sand.

BRIEF DESCRIPTION OF THE DRAWING

The above and other objects, features and advantages of the invention will become more readily apparent from the following description, reference being made to the accompanying highly diagrammatic drawing in which.

SPECIFIC DESCRIPTION

Figure 1:
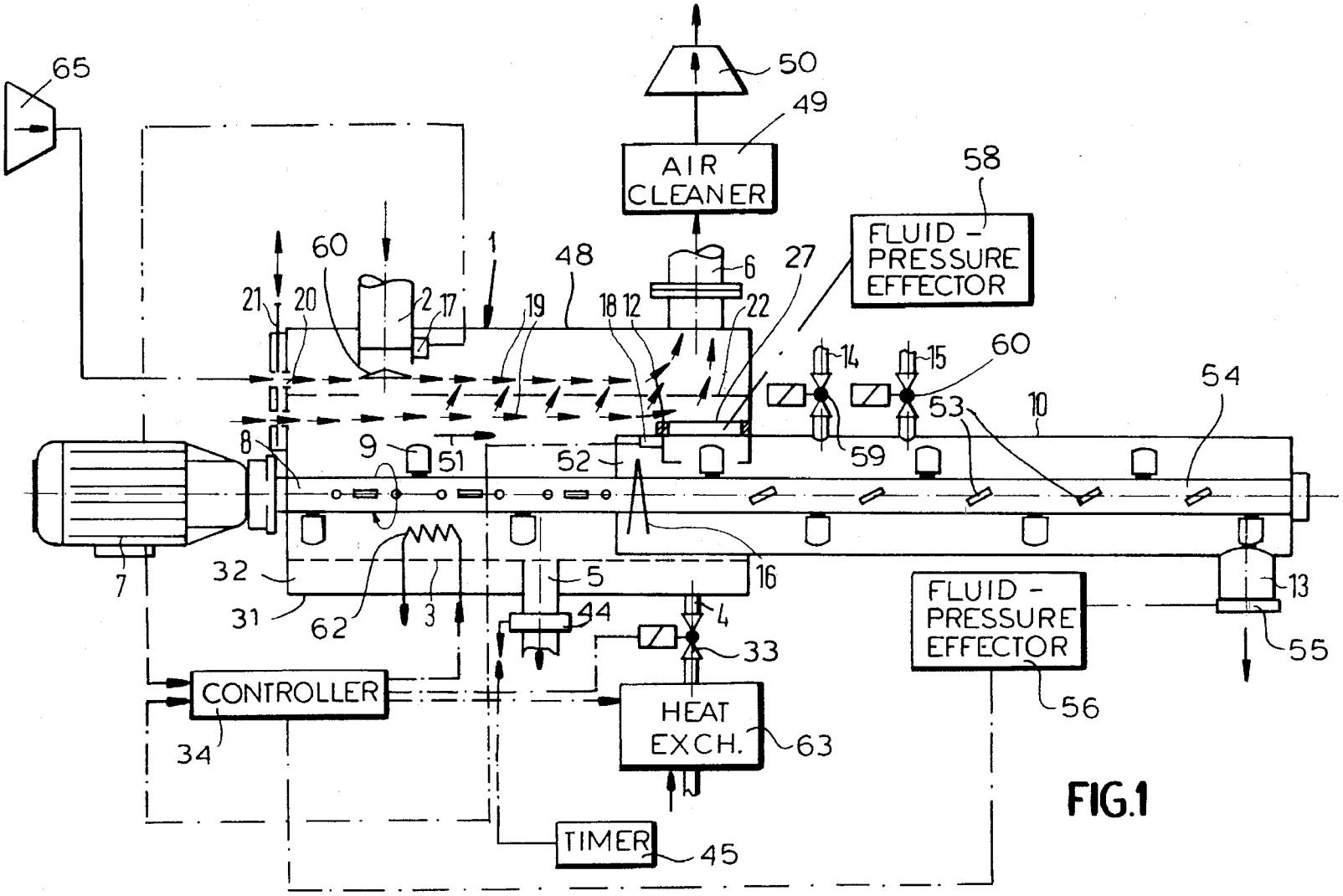
FIG. 1 is a diagrammatic longitudinal section through an apparatus for improving the characteristics of molding sand in combination with a mixing unit according to the invention.

FIG. 1 shows a housing 1 which defines a chamber serving to improve the working characteristics of sand. The sand to be treated is supplied to the chamber via an inlet 2 and falls toward a porous or finely perforated intermediate bottom 3.

The intermediate bottom 3 is disposed above the floor 31 to define a plenum 32 therewith, the plenum being supplied with compressed air by a compressed-air fitting 4 which can have a solenoid valve 33 allowing control of the influx of the compressed air to the plenum by a controller 34.

The porous intermediate bottom 3 also has at least one outlet unit represented at 5 for collecting coarse particles, agglomerates and pieces of greater specific gravity than the sand and which is closable. The closability is represented by a valve 44 in FIG. 1 which can be periodically operated by a timer 45.

Figure 5:
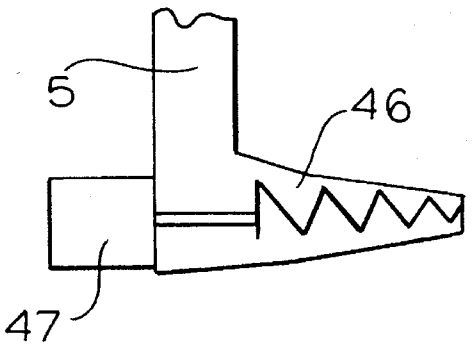
FIG. 5 is a cross sectional view showing another device for controlling the outflow from a discharge unit of an apparatus according to the invention.

Alternatively, as shown in FIG. 5, the discharge fitting 5 can be equipped with at least one worm conveyor 46 whose motor 47 can be periodically driven by the timer to unblock flow through the fitting 5.

At the top of the housing 1, i.e. along its ceiling or roof 48, a vent pipe 6 is provided which can be connected by ducts not shown to an air cleaning apparatus represented diagrammatically at 49 and ultimately to a suction blower 50 discharging the clean air into the atmosphere. The suction blower 50 generates a subatmospheric pressure in the upper region of the housing.

By means of an electric motor 7, a shaft 8 extending through the housing 1 can be driven. The shaft 8 is formed within the housing with paddles 9 which project radially from the shaft and serve to agitate the fluidized bed of sand which is maintained above the porous bottom 3 and which moves in the direction of the arrow 51 across the apparatus.

The shaft passes sealingly through an intermediate wall 52 into a mixing housing 10 and can be provided with blades or vanes 53 which can also be in the form of paddles and which can be inclined to the axis of the shaft in a direction so that, upon rotation of the shaft 8 and its extension 54 in the mixer housing 10, the sand is displaced through an outlet 13 provided with a fluid-pressure-operated closure 54. The effector for that closure is represented diagrammatically at 56. Similarly a closure 27 may have a fluid-pressure effector 58.

The sand enters the mixing housing through an elevated overflow 12 provided with the closure 27 at its upstream side. It will be understood that the closure 27 can be provided alternatively at the outlet side.

Within the mixer, the sand is mixed with a binder supplied by the binder feed pipes 14 and 15 having respective valves 59 and 60 for metering the binder into the sand. Within the mixer, therefore, the sand is combined with the binder at the upstream portion of the mixer. In the case in which the intermediate wall 52 is omitted, a worm or screw 16 can be provided on the shaft 8 to control the advance of the sand into and through the mixer. Advantageously, at the inlet 2 for the sand or in the region of the overflow 12 sensors such as temperature sensors 17 and 18, are provided to detect the sand temperature. Two or more temperature sensors can be used and can be provided at different locations. The outputs from the sensors are applied to the controller 34.

In operation, sand is introduced at the inlet 2 and is distributed by a baffle 60 over the porous plate 3. The upward flow of or through the porous plate at the pressure of the compressed-air line loosens the sand and fluidizes it to raise the level of the fluidized bed until substantially the overflow step 12. The paddles 9 of the shaft 8 driven by electric motor 7 further agitate the sand and help induce a vortex movement therein.

Fine particles, vapors and the like are entrained with the air out of the system through the fitting 6. Sludge which may be adherent to the sand particles is freed therefrom by the rubbing action. The contaminants which are lighter than the sand and the small sand particles are carried away by the compressed—air stream and are removed from the air in the downstream or cleaner or filter 49.

The airflow through the outlet 6 is reinforced by a flow 19 transversely across the fluidized bed through openings 20 of the end wall of the housing 1 which may be provided with a slider 21 for controlling or regulating this air flow. To ensure the orientation of the air stream 19 parallel to the upper surface of the fluidized bed, a baffle plate 22 can be provided parallel to this surface and formed with openings. The residual dust, smallest sand particles and binder residues are then entrained with the air flow 19 and carried off via duct 6.

It has been found to be advantageous to detect the temperature of the sand and to adjust this temperature by operating, e.g. a heater 62 within the housing, e.g. a heating coil, or to control the temperature of the compressed air supplied by a duct 4. For that purpose, a heat exchanger 63 regulated by the controller 34 is provided. The temperature sensors 17 and 18 supply inputs to the controller 34 to regulate the temperature so that the sand transferred to the mixing unit has a substantially constant temperature.

Multiple measurement is advantageous with intervening establishment of actual values.

When warm or hot air is supplied as a result of the heating in the manner described, the sand, which can be moist, can be dried and the flow characteristics of the sand improved. Specifically heavy components, for example, particles of metal spray and large components like sand agglomerates, descend upon the intermediate bottom 3 by gravity and collect on this bottom, to fall into the discharged outlet 5 from which they can be removed from time to time by advance of the conveyor 46 or opening of the closure 44 of the duct 5.

Since the sand must pass over the overflow step 12, only fluidized sand particles can pass to the mixer in which the sand is thoroughly mixed with the binder. Since agglomerates or specifically heavy components are excluded, a thorough homogeneous product is obtained with low binder utilization although the wetting of the surfaces of the sand particles is ensured. It is especially advantageous that because of elimination of previous binder residues, dust and sludge components, the integration of the binder in the sand is improved since components with excessive surface areas tending to accumulate binder are eliminated.

It has been also found to be advantageous that the sand emerges into the mixer at a predetermined temperature so that the hardening of the binder can be effected at a uniform given temperature. Shutdown of the compressed-air flow can terminate the fluidization of the sand spontaneously to cause the sand to drop below the overflow step and enable the mixer via the mixing vanes to empty itself. Upon turning on of the mixer there is a spontaneous renewal of fluidization and thus the flow of the treated sand from the housing 1 in the mixing housing 10. The shutoff and turning on of the flow of the mixed and dried fluidized sand can be effected as well by the switchable valve member 27 which can be a pneumatic or hydraulically-actuated slider.

Since the operation does not involve any lag of the sand when the closure is opened or closed, the supply of binder can be exactly predetermined and large quantities of poorly mixed or blended sand at startup or termination do not occur.

Figure 2:
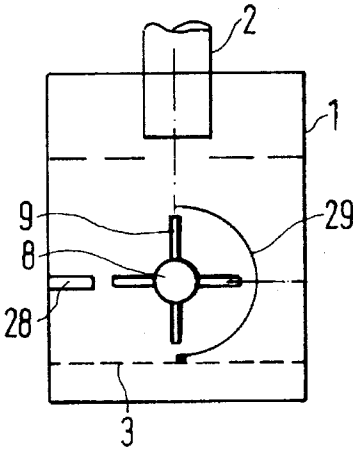
FIG. 2 is a diagrammatic section through the chamber of the apparatus of FIG. 1 showing baffles which influence the characteristics of the sand.

FIG. 2 shows a cross section through the housing 1 of FIG. 1, the paddles 9 cooperating with stationary paddles 28 or baffle bars to increase the rubbing effect on the particles with the advantages detailed above. The baffle 29 can reduce the fluidization locally to improve the efficiency.

Figure 3:
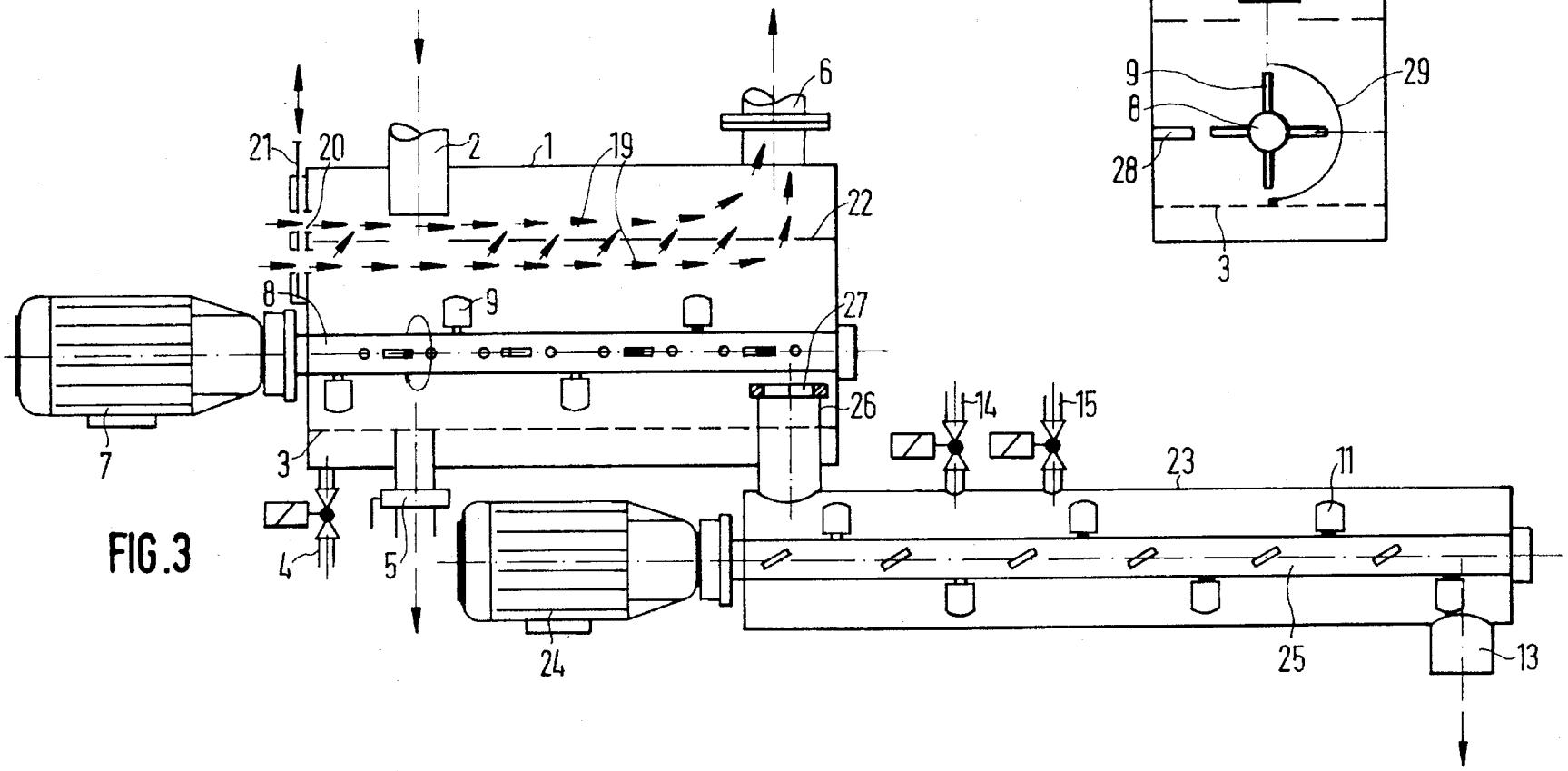
FIG. 3 is a view similar to FIG. 1 of another embodiment in which the mixing unit has a greater separation.

Another embodiment is shown in FIG. 3 which utilizes the same reference numerals as those of FIGS. 1 and 2.

Here the electric motor 7 drives a shaft 8 which extends only through the housing 1. For the mixer housing 23, a separate electric motor 24 is provided which exclusively drives the mixing shaft 25 so that the shafts 8 and 25 can be operated at different speeds.

The transition from the housing 1 to the mixing housing 23 is here formed by a downcomer 26 whose inlet end is at the level of the fluidized sand bed in housing 1 and determines this level.

In this embodiment as well, heating coils or the heating of the compressed-air feed to pipe 4 can be effected with control of the temperature in response to temperature sensors.

In this embodiment as well the fine particles and contaminants are entrained by the fluidizing air and the coarse particles and heavy agglomerates are carried away through the discharge 5. The reduction in dust and sludge components improves the gas permeability of the sand and reduces the dust release at the mixer outlet especially at startup and shutdown or idling of the mixer. A minimum of binder is required for a given strength and there is also a reduced glow loss which enhances the reusability of used sand.

Furthermore, sand encrustation in the region of the binder feed into the mixing zone is avoided.

In this embodiment as well, an additional airflow 19 can be provided, controlled by a slider 21 which can be displaced across openings 20. The transverse flow, which carries off the dust and sludge components as well as binder residues can also be heatable. A compressed-air source 65 can be provided for the air inlets 20 as shown in FIG. 1. The control or regulation of the sand temperature by preheating fluidizing air or by incorporating heating coils in the fluidizing chamber of housing 1 provides a reduction in the binder consumption, allows uniform processing times of the mold sand to hardening of the binder and affords other advantages.

The improvement in the mold sand allows the metering or dosing of the sand to be increased. The fact that, on shutdown of the mixer, the amount of sand which is thereafter discharged is reduced and the amount of poorly mixed sand resulting from startup of the mixer can also be reduced are further advantages. In this case the downcomer 26 can be provided with the shutoff member 27 so that an afterflow of sand is practically eliminated once this member is closed.

The apparatus of the invention also has advantages in terms of energy consumption since the fluidizing of the sand reduces the resistance with which the sand travels through the system and thus the system can operate with reduced power demand.

By change of the fluidizing air quantity, sand molds can be fabricated with mold sands as produced by the apparatus with different gas permeabilities. For example, a sand with increased proportions of a fine component can be produced to counteract the mineralization on casting. By increasing the fluidized-air quantity, some of the fine components can be separated out of the sand so that a mold sand can be produced with a significantly reduced binder component and higher gas permeability. Since the binder added has an effect on the flow loss of the mechanically regenerated old sand and thus the degree of reusability, the controlled fluidizing-air supply has special advantages in the case of the production of large sand molds.

Figure 4:
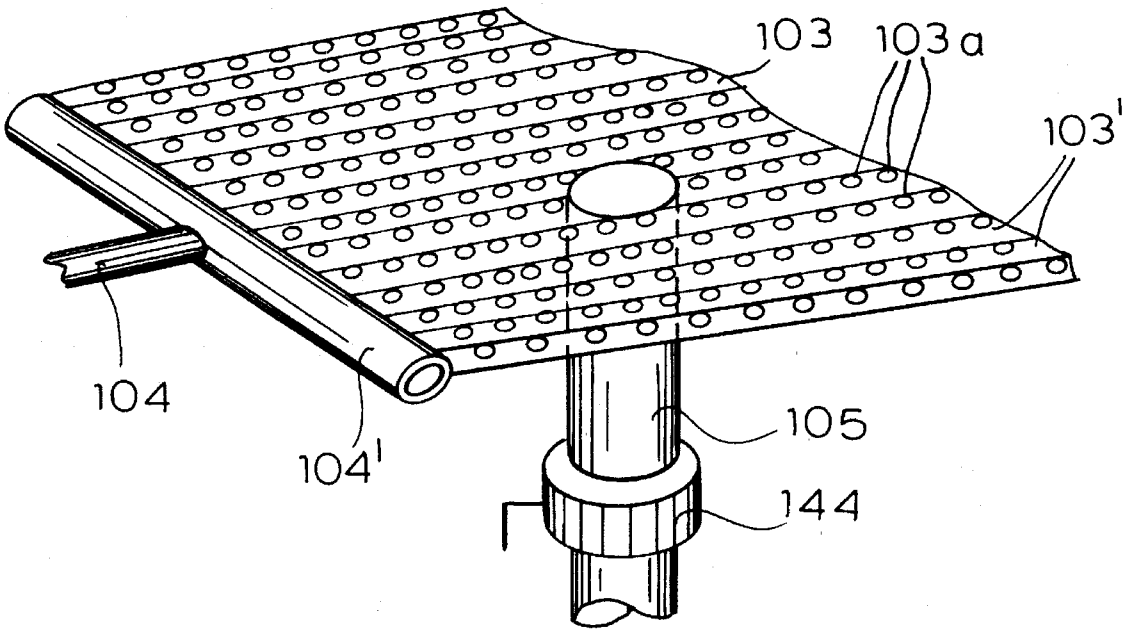
FIG. 4 is a perspective view of a multi-tube structure forming the intermediate bottom.

In FIG. 4 I have shown an intermediate bottom 103 supplied with compressed air by the duct 104 and the manifold 104', which comprises a multiplicity of parallel pipes 103' having openings 103*a* from which the compressed air emerges. The discharge duct 105 with its controllable closure 144 here opens in the array of perforated pipes. Otherwise an apparatus equipped with the aerating bottom of FIG. 4 functions similarly to that of FIGS. 1–3.

I claim:

1. An apparatus for the processing of reclaimed foundry sands by admixing binder thereto to improve reusability and working characteristics thereof, said apparatus comprising:

a housing formed with a processing chamber having an inlet for reclaimed used and new foundry sands and an outlet for treated sand spaced from said inlet;

aerating means forming an intermediate bottom above a floor of said chamber and provided with a compressed-air connection for fluidizing sand above said bottom and received from said inlet, thereby entraining contaminants upwardly from said sand as said sand moves from a region of said inlet to said outlet;

a venting fitting in a roof of said chamber for discharging air with entrained contaminants;

at least one closable discharge at a level of said bottom for receiving coarse components and components of greater specific gravity than the sand and removing said components from the sand;

a mixer connected to said outlet, directly following said housing and downstream thereof; and means for controlled addition of binder to sand in said mixer.

2. The apparatus defined in claim 1 wherein said aerating means includes an array of pipes formed with openings for discharging air into said chamber and provided with said compressed-air connection.

3. The apparatus defined in claim 1 wherein said aerating means includes a porous bottom defining with said floor an air plenum supplied with compressed air by said compressed-air connection, said compressed-air connection opening into said plenum.

4. The apparatus defined in claim 1, further comprising means for controlling compressed-air flow in said compressed-air connection to control an effective region for fluidization of the sand in said chamber.

5. The apparatus defined in claim 1, further comprising a heat exchanger upstream of said compressed-air connection.

6. The apparatus defined in claim 1, further comprising at least one heater in said chamber.

7. The apparatus defined in claim 1, further comprising a temperature sensor at at least one of said inlet and said outlet, and control means connected to said sensor for regulating a temperature of the sand in said chamber so that the sand emerging at said outlet has a predetermined temperature.

8. The apparatus defined in claim 1 wherein said mixer includes a rotatable shaft extending from said housing into said mixer and provided with paddles both in said housing and in said mixer.

9. The apparatus defined in claim 1 wherein an overflow step is provided between said chamber and said mixer and said fluidized sand rides over said overflow step in passing from said chamber to said mixer.

10. The apparatus defined in claim 1 wherein said closable discharge is formed with a periodically driven conveyor.

11. The apparatus defined in claim 1, further comprising a perforated baffle plate extending substantially parallel to a level of fluidized sand in said chamber above said level.

12. The apparatus defined in claim 1, further comprising a power-operated closure between said chamber and said mixer.

13. An apparatus for the processing of foundry sands to improve reusability and working characteristics thereof, said apparatus comprising:

a housing formed with a processing chamber having an inlet for used and new foundry sands and an outlet for treated sand spaced from said inlet;

aerating means forming an intermediate bottom above a floor of said chamber and provided with a compressed-air connection for fluidizing sand above said bottom and received from said inlet, thereby entraining contaminants upwardly from said sand as said sand moves from a region of said inlet to said outlet;

a venting fitting in a roof of said chamber for discharging air with entrained contaminants; and at least one closable discharge at a level of said bottom for receiving coarse components and components of greater specific gravity than the sand and removing said components from the sand; and at least one horizontal rotating shaft in said housing formed with impingement paddles engaging in the sand in said chamber.

14. The apparatus defined in claim 13, further comprising stationary counterpaddles on said housing in a region of said impingement paddles.

15. The apparatus defined in claim 13, further comprising stationary baffle bars on said housing in a region of said impingement paddles.

16. An apparatus for the processing of foundry sands to improve reusability and working characteristics thereof, said apparatus comprising:

a housing formed with a processing chamber having an inlet for used and new foundry sands and an outlet for treated sand spaced from said inlet;

aerating means forming an intermediate bottom above a floor of said chamber and provided with a compressed-air connection for fluidizing sand above said bottom and received from said inlet, thereby entraining contaminants upwardly from said sand as said sand moves from a region of said inlet to said outlet;

a venting fitting in a roof of said chamber for discharging air with entrained contaminants;

at least one closable discharge at a level of said bottom for receiving coarse components and components of greater specific gravity than the sand and removing said components from the sand; and fixed inserts in said chamber for controlling an effective region of fluidization of the sand.

17. An apparatus for the processing of foundry sands to improve reusability and working characteristics thereof, said apparatus comprising:

a housing formed with a processing chamber having an inlet for used and new foundry sands and an outlet for treated sand spaced from said inlet;

aerating means forming an intermediate bottom above a floor of said chamber and provided with a compressed-air connection for fluidizing sand above said bottom and received from said inlet, thereby entraining contaminants upwardly from said sand as said sand moves from a region of said inlet to said outlet;

a venting fitting in a roof of said chamber for discharging air with entrained contaminants;

at least one closable discharge at a level of said bottom for receiving coarse components and components of greater specific gravity than the sand and removing said components from the sand; and air-inlet openings formed in said housing above a level of fluidized sand in said chamber for inducing a transverse flow of air across said level.

18. The apparatus defined in claim 17, further comprising valve means for controlling flow of air through said air-inlet openings.

19. The apparatus defined in claim 17 further comprising means for connecting said air-inlet openings to a source of compressed air.

* * * * *